US005827555A

United States Patent [19]

Thorne et al.

[11] Patent Number: 5,827,555

[45] Date of Patent: Oct. 27, 1998

[54] FOAMING INSERT FOR A BEVERAGE CONTAINER

[75] Inventors: Nicholas Adrain Thorne, Echirolles; Claude Encrenaz; Mostafa Aboulfaraj, both of Voiron, all of France; Robert J. McHenry, St. Charles, Ill.

[73] Assignee: American National Can Company, Chicago, Ill.

[21] Appl. No.: 619,758

[22] PCT Filed: Sep. 28, 1994

[86] PCT No.: PCT/US94/11010

§ 371 Date: Jun. 27, 1996

§ 102(e) Date: Jun. 27, 1996

[87] PCT Pub. No.: WO95/09118

PCT Pub. Date: Apr. 6, 1995

[30] Foreign Application Priority Data

Sep. 28, 1993 [GB] United Kingdom ..... 9319932
Oct. 15, 1993 [GB] United Kingdom ..... 9321294

[51] Int. Cl.[6] ..... A21D 10/02; B65B 31/02; C08G 63/48

[52] U.S. Cl. ..... 426/112; 426/124; 53/432; 525/57

[58] Field of Search ..... 426/112, 124; 525/57; 53/432

[56] References Cited

FOREIGN PATENT DOCUMENTS

| | | |
|---|---|---|
| 0 518 522 A2 | 12/1992 | European Pat. Off. . |
| 0 577 284 A2 | 1/1993 | European Pat. Off. . |
| A 1 331 425 | 9/1973 | United Kingdom . |
| A 2 240 960 | 8/1991 | United Kingdom . |
| 2 267 882 | 12/1993 | United Kingdom . |
| WO 91/07326 | 5/1991 | WIPO . |
| WO 93/09055 | 5/1993 | WIPO . |
| WO 93/10021 | 5/1993 | WIPO . |

*Primary Examiner*—Donald E. Adams
*Assistant Examiner*—Hankyel T. Park
*Attorney, Agent, or Firm*—Wallenstein & Wagner, Ltd.

[57] ABSTRACT

An insert is provided containing gas under pressure for insertion in a carbonated beverage can to nucleate release of gas from solution when the can is opened. The insert has a jetting orifice closed by a burstable seal which is held closed by a sealing member until the can is opened. The sealing member may be made of moisture sensitive material which weakens in the can and ruptures on opening the can. The insert may be weighted to float in a given orientation with the jetting orifice submerged.

41 Claims, 10 Drawing Sheets

FOAMING INSERT FOR A BEVERAGE CONTAINER

BACKGROUND

This invention relates to a foaming insert for a beverage container.

There is an expectation for a frothy head to be formed on beer, when this is poured into a glass, the froth being produced by release of carbon dioxide dissolved under pressure in the beer. The action of pouring the beer causes the initiation of gas release to cause a foaming effect to produce the froth.

It is often required to cause a froth to be formed on opening of the container, for example, where the contents are to be drunk directly from the container, and it has been known for some years to provide means to initiate the foaming action as soon as the container is opened and pressure in the container is released. The usual way to do this is to provide a secondary compartment in the container containing gas under pressure. The gas is released through a nozzle, on opening of the main container, to cause "seeding" of gas release from the container contents.

The contents may, of course, be beverages other than beer and the gas dissolved in the beverage may be nitrogen as well as carbon dioxide. The gas provided in the secondary compartment will usually be carbon dioxide, or nitrogen.

An early example of such a container is disclosed in GB-A-1266351 published 1972. The secondary chamber was fixed to the bottom of the container with a nozzle opening to the container contents. The contents of the container main chamber and the secondary chamber are in pressure equilibrium until the main chamber is opened, when differential pressures causes release of a stream of bubbles from the secondary chamber.

This document discloses that the nozzle may be sealed by gelatine to permit charging of the secondary chamber with gas prior to filling of the main chamber with beverage. The gelatine seal is dissolved by the beverage to open the nozzle, which contaminates the beverage.

The document also discloses the alternative of providing a valve instead of the gelatine seal, the valve being openable due to pressure differential when the main chamber is opened.

There have been many developments since, of the principles disclosed in this document, e.g. as disclosed in GB-A-1331425, WO92/00096, WO92/00097, GB-A-2211813, GB-A-2240960, EP-A-0360375, EP-A-0360373, GB-A-2256628, WO91/13006, GB-A-2257132, WO91/09781, GB-A-2183592, GB-A-1588624, WO91/00825, GB-A-2257107 and WO91/07326.

Some of these documents disclose the principle of charging a separate insert with gas and providing the insert in the container, prior to filling the container. GB-A-2240960 discloses such an insert, which is magnetically retained beneath the liquid contents of the container.

GB-A-2183592 and WO91/07326 disclose, among many proposals, the provision of a floating insert, which is charged with gas and caused to float on the beverage, so as to project into the head space. The nozzle is held below the liquid by weighting of the floating insert.

A disadvantage of the use of a secondary chamber, whose nozzle is open to the contents of the main chamber prior to opening of the main chamber, is that a substantial amount of the liquid contents enters the secondary chamber. This is caused by changes in pressure due to temperature changes.

The container and its contents are usually subjected to a pasteurisation step, followed by cold storage.

Where a valve is used, the valve has to remain closed before and after insertion of the insert in the container and to open only when the container is opened. One way of achieving this, as disclosed in WO91/07326, is to charge the insert with gas above atmospheric pressure and to maintain the insert under superatmospheric pressure until the container has been sealed. This is clearly a difficult procedure to carry out.

The document discloses an alternative of filling the insert at atmospheric pressure and utilising the pasteurisation step to cause a permanent reduction in volume of the insert, so that the gas in the insert is pressurised after insertion in the container.

A further alternative disclosed, is to charge an insert with liquified gas prior to assembly of the insert. A valve member is held by a resilient wall in a position closing a nozzle, the pressure, which subsequently builds up in the insert, acting to urge the valve member in the closing direction. The pasteurisation step is utilised to deform the insert and move the valve member to a position, in which it is permanently fixed. On opening of the container, the resilient wall is caused to release from the valve member to open the nozzle.

This is a complex arrangement, which is expensive to make so that it will operate reliably. A further disadvantage is that the valve will reclose as the pressure difference across the valve reduced, so that only a portion of the charged gas is utilised.

Plastics have substantial advantages for ease of manufacture of an insert, but provide a substantial disadvantage. The whole of a can, including its insert should be made of the same material to permit recycling.

Plastic causes problems for recycling when inserted in aluminium or steel cans. The insert should be primarily aluminium, where the cans are aluminium, but aluminium is also suitable for recycling when used in steel cans.

OBJECTS OF THE INVENTION

An object of the invention is to provide a foaming insert for a beverage container, which overcomes the above disadvantages.

A further object is to provide such an insert, which can be charged with gas prior to insertion in the container and stored at atmospheric pressure.

A further object is to provide such an insert whose internal pressure can be increased during the step of pasteurising the beverage in the container and the increased pressure maintained until the container is opened.

A further object is to provide such an insert which can be cheaply and easily made.

A subsidiary object is to provide such an insert which floats on the beverage and is maintainable in a position in which the gas jetting orifice is submerged in the beverage during jetting.

A further subsidiary object is to provide an insert with a jetting orifice sealed by a member, which is moisture sensitive, but does not dissolve in the beverage.

A further object is to provide an insert with a sealing member for its jetting orifice, which member burst open to provide a sudden escape of pressure from the insert into the beverage.

A subsidiary object is to provide such an insert which floats on the beverage and is maintainable in a position in which the gas jetting orifice is submerged in the beverage during jetting.

A further subsidiary object is to provide such an insert, which may contain an oxidising gas and does not need to be purged of oxygen.

A further subsidiary object is to provide for uniform jetting of gas into a beverage over the jetting period.

SUMMARY OF THE INVENTION

The invention provides a foam-inducing insert for inclusion in a container containing a beverage with gas dissolved under pressure to initiate release of gas from the container on opening of the container, the insert comprising:

a housing having a chamber;

gas within the chamber;

the chamber having an orifice through the housing;

and closure means closing the orifice and operable under pressure difference across the orifice caused in use by opening of the container, whereby gas is jetted into the container;

the closure means comprising a sealing member secured around the orifice to provide a seal, the seal being burstable under said pressure difference.

In one embodiment, the chamber is filled with gas under pressure and the sealing member is rupturable and moisture-sensitive. The insert can be stored in dry conditions with the sealing member intact. Within the beverage container, however, the sealing member takes up moisture and becomes weaker. On opening of the container, the weakened member ruptures under the sudden pressure drop. The preferred material is an ethylene vinyl alcohol (EVOH) copolymer.

In an alternative embodiment, the sealing member is adhered around the orifice by a moisture-sensitive adhesive, such as an EVOH or polyvinyl alcohol adhesive, which permits dry storage of the insert, but weakens in the beverage container so that the seal is burst by release of the sealing member on opening of the container. The sealing member should be retained on the insert, for example by means of a non-moisture sensitive adhesive adhering a portion of the member to the housing.

In another embodiment, the sealing member is rupturable (but not necessarily moisture-sensitive) and is adhered in an inner region around the orifice by a moisture-sensitive adhesive. The member is more strongly adhered in an outer region. On opening of the container, the weakened inner region adhesive releases the member, while the outer region remains secure. This presents a larger area of the member to the pressure shock causing rupturing of the member.

Rupture of the sealing member is preferred, since this is highly effective in nucleating the release of bubbles. This arrangement also permits a delay to be allowed for, between opening of the container and actual rupture.

In a further embodiment, the housing includes a second chamber with a diaphragm separating the chamber and arrayed so that pressure in the second chamber is applied through the diaphragm to the first chamber. The second chamber is pressurised by communication with the interior of the container.

This communication may be provided by a small orifice, which allows only slow passage of gas therethrough for slow pressure equalisation within the container.

Alternatively a larger orifice covered by a gas-permeable film may be provided.

The second chamber is preferably charged with a non-oxidising gas, such as nitrogen, to avoid oxidation of the container contents. An oxygen scavenger may be included in the second chamber for scavenging oxygen from the headspace in the container. The second chamber could exist only when pressurised in the container, the diaphragm being initially in contact with the housing.

To prevent air entering the second chamber during storage of the device, the orifice is preferably closed by a gas-impermeable rupturable film, which ruptures under the pressure differential established when the insert is sealed in a pressurised beverage container.

The diaphragm is preferably made of malleable material, such as soft aluminium, which collapses in a uniform manner, so as to provide uniform jetting of gas from the first chamber by the collapsing diaphragm. This provides controlled nucleation of bubbles over a period, instead of a rapid decline in pressure, which causes the nucleating effect rapidly declines.

This arrangement also permits the volume of gas to be jetted to be varied without changing the external size and shape of the housing. This enables the same insert placing equipment to be used for different inserts for different types of beer. The variation is possible by changing the size of the first chamber, or by adjusting the pressure in the first chamber during manufacture, relative to that in the second chamber, thereby varying the size of the first chamber.

The invention also provides a sealed container containing a beverage with gas dissolved under pressure and with a gas-containing headspace above the beverage, and an insert in the container and containing gas under pressure, the insert having:

a first orifice positioned to communicate with the container interior, a one-way valve closing the first orifice when the internal insert pressure exceeds the container interior pressure and openable when the container interior pressure exceeds the internal insert pressure, a second orifice positioned to communicate with the container interior, a burstable seal held in a position closing the second orifice and adapted to resist opening under differential pressures across the valve generated during pasteurisation of the container and its contents, the burstable seal being openable under the differential pressure created on opening of the container to release the insert contents through the second orifice.

This arrangement enables the insert to be charged with gas and stored at atmospheric pressure, with the valve preventing gas leakage.

The charging pressure can be increased during the pasteurisation of the beverage. The valve opens as the pressure increases during pasteurisation and recloses as the pressure drops on cooling. During this procedure, gas, beverage, or a mixture from the container, enters the insert and is retained in the insert. The valve remains closed after the container is opened and gas or gas/beverage mixture is jetted solely through the second orifice.

It is preferred that substantially only gas is jetted through the second orifice. This is attained by ensuring that the first orifice communicates only with the headspace. It is also preferred that the second orifice is submerged in the beverage when and shortly after the container is opened, so that the gas is jetted into the beverage. This arrangement provides the best conditions for initiation of foaming, with optimum use of the insert internal volume.

It is also preferred that the insert floats in the beverage, since this avoids the need to mount the insert in a fixed location in the container.

Another aspect of the invention, as described hereafter, enables the floating insert to be orientated to ensure that the contents of the insert are jetted into the beverage and not the headspace.

The invention also resides in an insert for insertion in a container containing a beverage with gas dissolved under pressure, prior to sealing of the container, to initiate release of gas from the container on opening of the container, the insert comprising:

gas under pressure contained in the insert, a first orifice closed by a one-way valve when the internal pressure exceeds the external pressure, a second orifice spaced from the first orifice and closable by a burstable seal held closed against the pressure differential between the internal pressure and atmospheric pressure and against a predetermined pressure differential, the burstable seal being openable when said predetermined pressure differential is exceeded.

The invention also provides a method of producing a sealed container containing a beverage with gas dissolved under pressure and an insert in the container containing gas under pressure, which gas is released on opening of the container, the method comprising.

charging the insert with gas under pressure through a first orifice, the insert having a one-way valve which is urged to close the first orifice when the internal insert pressure exceeds the external pressure, providing the insert with a second orifice and a burstable seal which is held closing the second orifice and withstands the pressure differential between the internal pressure and the external pressure, inserting the insert into a container containing the beverage and sealing the container, exposing the sealed container to pasteurising conditions such that the pressure in the container is increased and communication occurs through the first orifice between the insert and the container interiors, and cooling the sealed container, so that the valve closes to maintain the increased pressure in the insert, the burstable seal also withstanding the pressure differentials during the pasteurising and cooling steps, the burstable seal being openable under the differential pressure produced on opening of the sealed container.

The one-way valve may be dispensed with, if the first orifice is made substantially smaller than the second orifice. With this arrangement, the interior pressure of the insert will equalise after pasteurisation and during storage with that of the container, due to the communication through the first orifice. The provision of the valve, however, permits use of a relatively high internal pressure in the insert and hence the insert may have a smaller volume.

The burstable seal, which closes the second orifice, may be designed to open when there is an abrupt reduction of pressure on opening of the container. There will still be a sudden pressure differential across the seal and jetting of gas through the second orifice, because venting through the smaller first orifice will be slow.

The advantage of orienting the floating insert, with its jetting orifice submerged in the beverage, is referred to in GB-A-2183592. The only disclosure, however, is briefly to weighting the insert. WO91/07326 describes and illustrates a weighted, floating insert, wherein the insert is made of a plastics material.

Plastics have substantial advantages for ease of manufacture of an insert, but provide a substantial disadvantage. The insert should be made of a material which permits recycling.

Aluminium and steel cans are commonly used and the insert should, be made of aluminium for recycling purposes. Aluminium is an expensive material and needs to be sparingly used resulting in a lightweight insert.

It has now been found that, if the metal insert is sufficiently light, the reactive force generated on the insert as the gas jets from the insert can propel the insert towards the top of the container. It is, therefore, preferred that the dimensions of the floating insert parallel to the container axis are sufficiently great relative to the headspace depth, to ensure that the jetting orifice remains submerged. This problem would not usually arise with plastics inserts.

If the insert is sufficiently light, the angular alignment of the insert can be determined by contact between the inner surface of the top of the can and the top of the insert and such contact could cause the jetting orifice to open into the headspace. This is avoided according to one aspect of the invention by ensuring at least three point contact between the contacting surfaces.

Floating stability of the insert is also important to ensure that the insert remains in the desired position. The problem of angular alignment would be alleviated by use of a large insert of relatively shallow depth, but such an insert would be stable in an inverted floating position and also be tilted on opening of the container by projection of a hinged opening member into the interior of the container.

The various constraints, including gas capacity, means that an elongate insert is preferred, which floats with its longitudinal axis generally upright and has the at least three point contact feature, so that the jetting orifice is always submerged.

Weighting is provided, below the liquid level, to tilt the floating cylinder towards a vertical position. Plastics "weights" with a plastics insert would not achieve this effect, due to the low density of the plastics material.

It has been found that with these constraints, the weighting of the insert can be reduced, so that the insert floats generally upright, but with its longitudinal axis at an acute angle to the vertical. For a cylindrical insert, this angle should be θ or less, where:

$$\theta = \tan^{-1} R/L$$

where R is the radius of the cylinder, L is the distance from the upper face of the cylinder to the point where the vector of buoyancy intersects the axis of the cylinder. The vector of buoyancy is colinear with the weight vector.

It is preferred that the insert is then caused to float in a given rotational orientation by asymmetric weighting of the insert, with the jetting orifice spaced from the longitudinal axis towards the region of maximum weighting.

In another embodiment, liquid is contained in the insert to reduce the amount of aluminium weighting required.

The above calculation was made on the assumption that an added weight of solid aluminium of the form of a circular disc was joined to the original cylinder at its lower end. If this same disc of aluminium is rigidly attached in such a way that its own center of mass is located at a distance from the lower end of the original cylinder, less added mass will be required.

Similarly, if the lower portion of the hollow cylinder is filled with liquid rather than gaseous product, less added weight will be required.

The problem of the insert being jetted against the top of the container can be prevented by reducing the diameter of the jetting orifice, although this may affect the nucleation effect of the jetted gas in the beverage. The critical maximum diameter can be determined by:

$$\text{CriticalDiameter} \leqq \sqrt{\frac{4 \times Wt}{\Pi \times \text{Pressure}}}$$

It is important to prevent oxygen from contacting the beverage in the container, since this may lead to spoilage. It has been necessary to be careful to purge inserts of oxygen prior to filling and closing of the container. One reason for this is that inserts have been made of plastics materials, which are gas permeable, as disclosed in WO91/07326, so that oxygen could permeate to the beverage. In some inserts, which have an orifice open to the beverage, oxygen could also pass from the insert to the beverage through the orifice.

The use of aluminium for the body of the insert, coupled with the provision of a valve for closing the insert interior to the beverage overcomes this disadvantage. It is possible for the gas in the insert to include oxygen, since this cannot escape from the insert to the beverage, until the container is opened. Where the insert has two valves, as described above, the one-way first valve, which closes when the container interior pressure is less than the insert interior pressure, prevents escape of oxygen from the insert. The insert could therefore be filled without protection in air.

DESCRIPTION OF PREFERRED EMBODIMENTS

Figure 1:
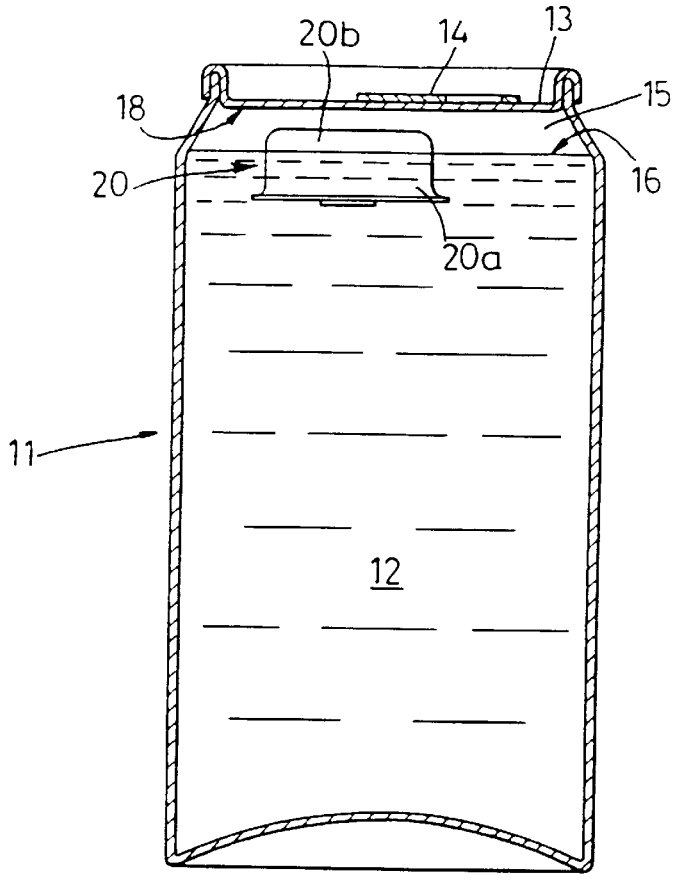
FIG. 1 is a sectional view through a sealed, beverage can including a floating insert according to the invention.

There is shown in FIG. 1 a container in the form of an elongate, cylindrical, metal can 11 of conventional design, containing a carbonated beverage 12, such as beer. The can 11 is closed by a lid 13 peripherally secured to the can to seal the can, the lid 13 being provided with a conventional, sealed, openable tab 14. A headspace 15 is provided between the upper surface 16 of the beverage 12 and the lid 13. The inner surface 18 of the lid has a slight concave dome shape, in conventional manner.

An insert 20, containing gas under pressure, is provided in the can and floats in the beverage 12 with a lower portion 20*a* submerged and an upper portion 20*b* extending into the headspace 15.

Figure 2:
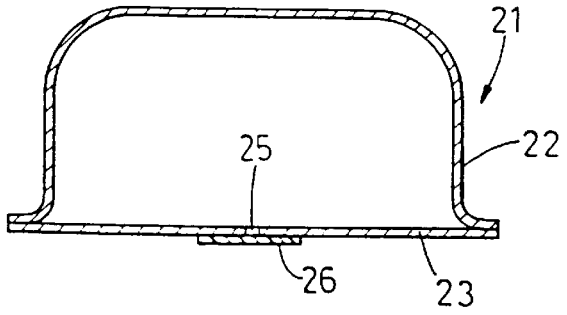
FIG. 2 is a sectional view of a first embodiment of an insert according to the invention.

The insert 20 is more clearly shown in FIG. 2 and comprises a hollow housing 21 having a body 22 of inverted cup shape, closed by a disc 23. The body 22 is made of a rigid aluminium alloy and the disc may be of a heavier metal, or carry a weighted portion for weighting the insert, so that it will float on liquid with the disc below the liquid surface. Other materials, such as plastics may be used for the housing.

The disc has an orifice 25 for jetting of gas from the interior of the housing into liquid in the can 11.

Figure 3:
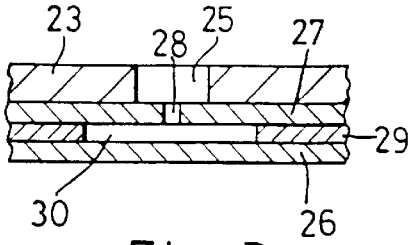
FIG. 3 is a diagrammatic view of a sealing strip of the insert of FIG. 2.

The orifice 25 is closed by a sealing member 26, which may be directly secured to the disc 23 to form a burstable seal. Preferably, however, a substrate 27 (FIG. 3), provided with a jetting orifice 28, is secured to the disc 23, with the sealing member 26 secured to the substrate.

The sealing member comprises, in one embodiment, a rupturable plastics strip 26 adhered to the substrate 27 by adhesive 29 around the orifice 28. A region 30 of the strip adjacent the orifice 28 is left unadhered to the disc.

The strip 26 comprises a moisture-sensitive material, whose rupture strength reduces after exposure to moisture. The housing is pre-charged with gas under pressure.

The strip 26 has sufficient rupture strength to permit prolonged storage of the insert in dry conditions. Within the can, however, the exposure to the can contents weakens the strip. The differential pressure across the strip in the can is insufficient to rupture the strip, but the sudden drop in pressure, on opening the can, causes rupture and the seal bursts open to permit jetting of gas into the can contents.

The strip 26 may be made of an ethylene vinyl alcohol (EVOH) copolymer film. The copolymer preferably includes 40% or less of ethylene monomers and in one example comprises 32% ethylene monomers. A suitable material is commercially available as type EF-XL. This film is 15 microns thick and is biaxially oriented.

The unadhered region 30 of the strip using this material and an internal gas pressure of 3 atmospheres is 2 mm in diameter (about 3 $mm^2$).

This construction was found to be storable in the dry state. When left in a can filled with beer containing carbon dioxide and nitrogen under pressure, the sealing strip remained intact, but, on opening the can, the strip ruptured in the unadhered region 30.

Plastics material lose strength during storage under stress and may suffer creep rupture and it is important to choose a material for the sealing strip, which loses less strength for this reason, during dry storage, than due to moisture sensitivity. The material disclosed above meets this requirement and it is believed that the biaxial orientation reduces the tendency to creep rupture. It is preferable to store at low temperatures to reduce this tendency.

The creep rupture property may be utilised to provide a delay in rupture after opening of the container. The sealing strip is arranged so that it stretches under the differential pressure and suddenly ruptures after a second or more delay.

The EVOH sealing strip is temperature sensitive and has a greater rupture resistance when cold. This property prevents premature opening of the sealing strip as disclosed later in this description.

The EVOH layer may be coated, or laminated, with a film which reduces its moisture sensitivity. This also helps to prevent premature opening, by delaying the strength reduction until the pressure in the can has built up by escape of gas from the beverage.

The general relationship between internal pressure, the area of unadhered region and the strip thickness is as follows:

$$PA^{1/2}/t=0.35$$

wherein P=gauge pressure in atmospheres

A=unadhered region in $mm^2$ t=film thickness in microns

The housing may be charged with air, avoiding the need for using a non-oxidising gas, since EVOH, even after moisture expansion has good gas barrier properties, so that oxygen will not appreciably pass into the can and spoil the contents.

In a modification, a non-moisture sensitive strip 26 may be used, the seal being burstable by use of a moisture sensitive adhesive 29, e.g. an EVOH adhesive, which releases the strip to uncover the aperture.

Figure 4:
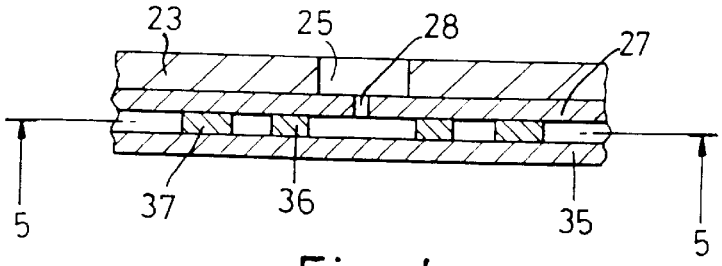
FIG. 4 is a diagrammatic view of an alternative sealing strip for the insert of FIG. 2.
Figure 5:
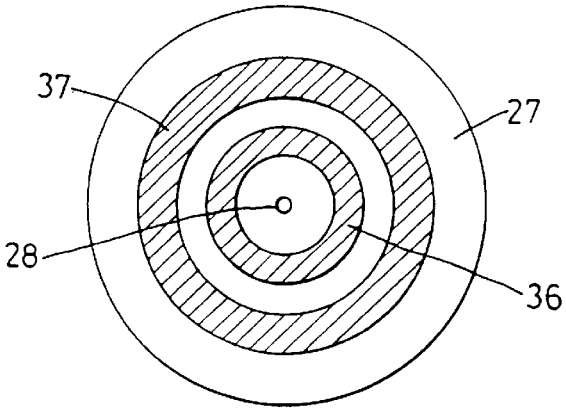
FIG. 5 is a view on the line 5—5 of FIG. 4.

In a further embodiment, as shown in FIGS. 4 and 5, a rupturable strip 35 is adhered to the substrate 27 in two regions. A moisture-sensitive EVOH adhesive is used to adhere the strip 35 to an inner annular region 36 of the substrate around the orifice 28. An outer, annular adhesive region 37 provides greater adhesion. This is provided by using a stronger, non-moisture sensitive adhesive, or the same adhesive over a substantially larger area.

In use, on opening the can, the strip 35 is released at the inner region exposing a larger area of the strip to the differential pressure caused, so that the strip bursts.

The sealing may be provided on a bush, secured in an aperture in the insert, the bush being provided with the jetting orifice.

The insert according to any of the above embodiments can be easily recycled along with the can. There is no necessity to purge the insert of oxygen and no need to store, or ship in an oxygen free environment.

Figure 6:
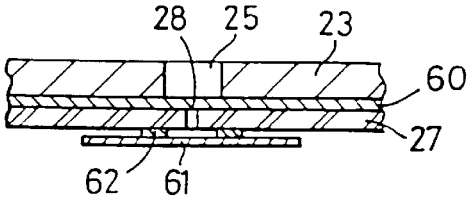
FIG. 6 is a diagrammatic view of an alternative sealing strip.
Figure 8:
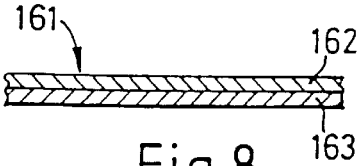
FIG. 8 is a diagrammatic view of a closure strip for the insert of FIG. 7.

A further embodiment of the invention shown in FIG. 6 avoids the necessity for precharging with pressurised gas and the necessity to store in a moisture free environment.

In this embodiment, a thin, burstable gas-impermeable layer 60 is provided between the substrate 27, having the jetting orifice 28, and the disc 23 of the insert body. The sealing strip 61 is made of gas-permeable material and the substrate is also preferably gas permeable. The sealing strip 61 is rupturable and is adhered to the substrate 27 by a ring of adhesive, which may be moisture sensitive, as described above.

In use, the insert is filled with an oxidising gas, such as air, substantially at atmospheric pressure.

With the insert provided in a closed beverage can, gas under pressure in the can passes through the permeable layers, so that pressure builds up on one side of the gas barrier layer 60. The pressure build up eventually ruptures the gas barrier layer, so that pressure can equalise across the sealing strip 61.

The sealing strip 61 ruptures due to the sudden drop in pressure on opening of the can.

In a modification, the arrangement shown in FIG. 2 is modified by provision of a gas barrier layer on the internal face of the disc 23 of the insert body, the jetting orifice being in the disc instead of a substrate, as in FIG. 6.

Figure 7:
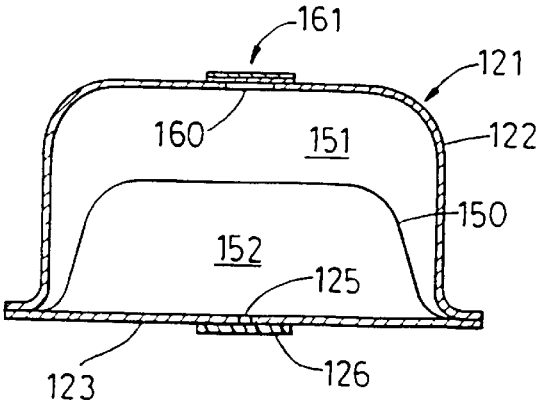
FIG. 7 is a sectional view of a further embodiment of an insert according to the invention.

In a further embodiment, shown in FIG. 7, the insert has a housing 121 with a body 122 and disc 123, as in the previously described embodiments.

The insert includes an internal diaphragm 150, which is cup-shaped and divides the body interior into upper and lower chambers 151,152. The diaphragm is collapsible, but sufficiently rigid to maintain the cup shape unless subjected to collapsing forces. It may be made, for example, of a soft aluminium alloy.

The disc 123 has a jetting orifice 125 closed by a sealing member 126 and the lower chamber 152 contains a gas, which may be air, under atmospheric, or low pressure.

The upper chamber 151 has a charging orifice 160 in the top of the housing and closed by a closure strip 161. This chamber contains a non-oxidising gas, such as nitrogen, at atmospheric pressure or a little below atmospheric pressure. The closure strip 161 comprises two superimposed layers, which are weakly adhered to each other. The outer layer 162 comprises a gas-permeable material, whereas the inner layer 163 comprises a rupturable gas-impermeable material.

After the insert has been placed in a sealed can of beverage, the gas under pressure in the can will permeate through the outer gas-permeable layer 162 and the inner layer 163 will be caused to rupture due to the pressure differential across the layer. The gas will then pass through the charging orifice 160 to pressurise the upper chamber 151.

Figure 9:
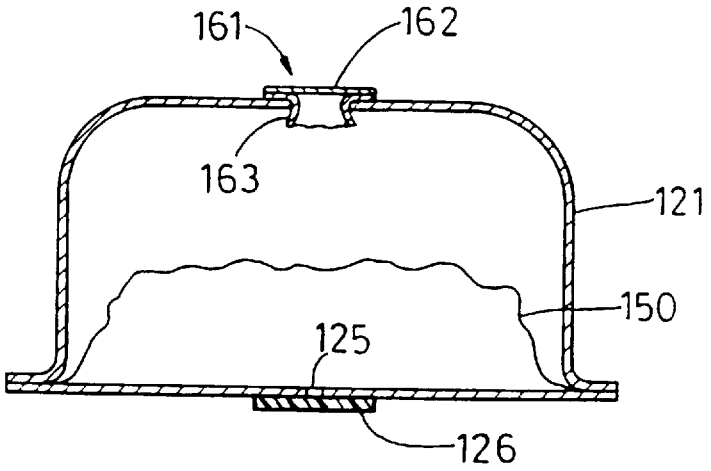
FIG. 9 is a view similar to FIG. 7, showing a diaphragm partially collapsed after pressure-charging of the insert in a beverage can.

This pressure is transferred through the diaphragm 150 to the lower chamber 152, this diaphragm beginning to crush, so that the pressure in the lower chamber almost equalises with that in the upper chamber. The partially crushed diaphragm and ruptured layer 163 are shown in FIG. 9.

On opening of the can, the sudden pressure drop across the sealing strip 126 causes it to rupture and gas is jetted from the lower chamber into the can.

Figure 10:
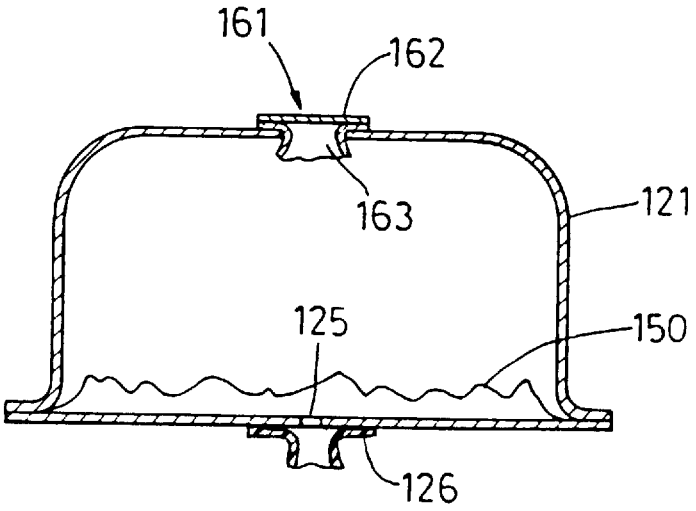
FIG. 10 is a view similar to FIG. 9, showing the diaphragm fully collapsed after opening of a beverage can.

During jetting, the diaphragm crushes as the pressure in the lower chamber drops relative to that in the higher chamber. All of the gas is jetted at a significant pressure providing a generally uniform jetting rate over the jetting period. This crushed diaphragm and ruptured sealing strip 126 are shown in FIG. 10.

Some gas under pressure remains in the upper chamber at the end of the jetting period, but this is dissipated through the gas-permeable layer 162 of the closure strip 161.

It is not essential for an insert operating in this manner to float in the can and the insert could be filed, if desired, below the liquid level.

With a floating insert, however, it is possible for the closure strip 161 to be dispensed with, if the orifice 160 is made very small, so that gas can pass only slowly through the orifice.

It is, however, still preferred to provide a burstable seal, e.g. by means of a rupturable layer covering the orifice. This will prevent oxygen from entering the insert during storage.

The rupturable material for the sealing strip 126 and the rupturable layer 163 of the closure strip 161 may be a high gas-barrier polymer such as EVOH, polyvinylidene chloride, polyamide or polyester, or may have two or more layers including a gas-barrier layer. Other possible materials include thin metal foil, or metallised plastics film, or inorganic oxide coated plastics film, such as silicon oxide applied by vapour deposition.

The gas-permeable layer 162 may comprise low density polyethylene, an ionomer such as Surlyn, cellulose acetate butylate, or a porous plastics paper such as Tyvek.

Similar materials may be used in the embodiment of FIG. 6.

The upper chamber 151 may include an oxygen scavenger.

Potassium sulphite is often used in cans of beer for this purpose, but, being soluble in beer, it spoils the flavour and contaminates the beer. If placed in the can, it will also scavenge oxygen from the air during the handling and filling procedures before the can is sealed.

The provision of an oxygen scavenger in the upper chamber 151 means that it never comes into contact with the beer and is sealed from the atmosphere during handling by the closure strip 161. Oxygen is scavenged within the upper chamber without contact with the beer.

In a further embodiment (not shown) the diaphragm is omitted and the whole interior of the insert is allowed to get its pressurisation from the beverage. The charging orifice may be closed by providing the burstable gas barrier film in the interior of the insert and the gas permeable film on the exterior of the insert.

If a very small charging orifice is provided, the gas permeable film may be omitted.

Figure 11:
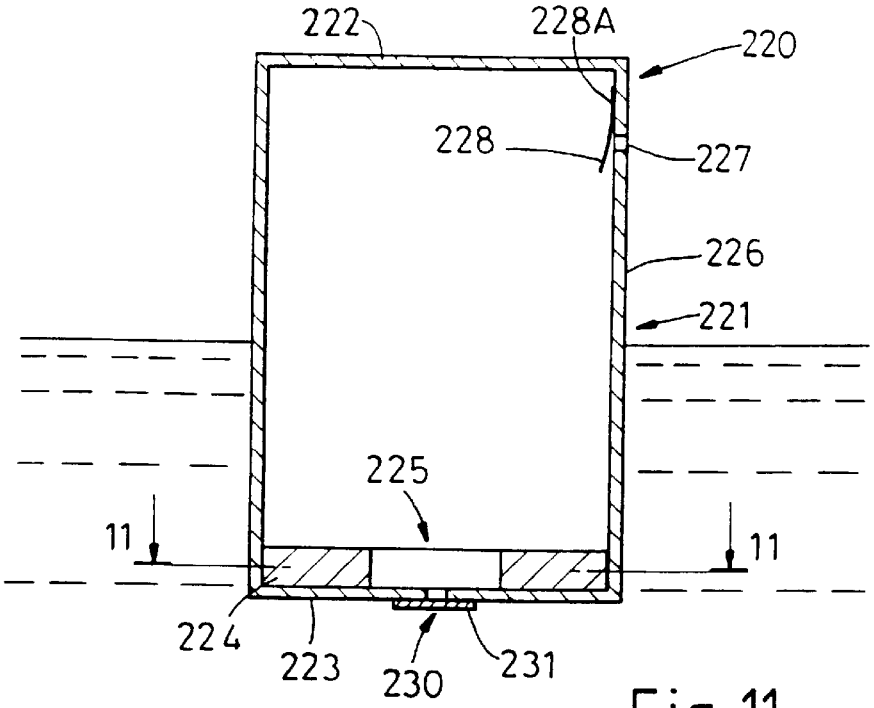
FIG. 11 is a sectional view of a further embodiment of an insert of the invention.
Figure 12:
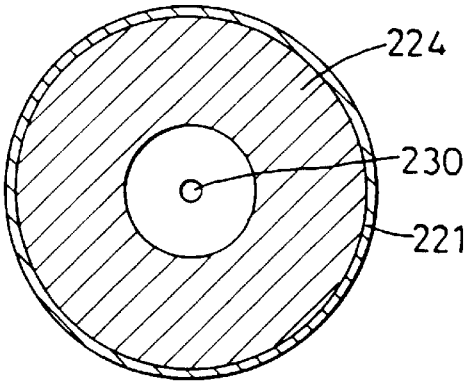
FIG. 12 is a sectional view of a modification of the insert of FIG. 11.
Figure 13:
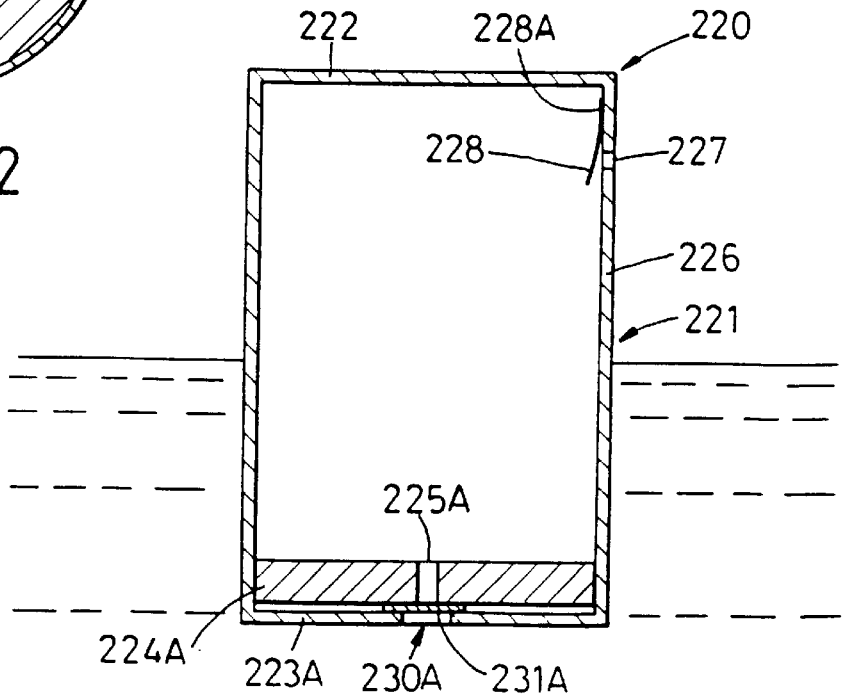
FIG. 13 is a sectional view on line 12—12 of FIG. 12.

Another embodiment of an insert 220 is shown in FIGS. 11 and 13 and comprises a hollow, elongate, cylindrical body 221 closed at both ends by upper and lower end walls 222,223. Other shapes for the body may be used.

The insert includes a disc-shape aligning weight 224 secured internally of the body to the lower wall 223, so that the body floats with its axis vertical. The weight may be made of metal, for example. The body may be a plastics moulding, but is preferably made of metal, such as aluminium.

The cylindrical wall 226 of the body has a charging orifice 227 in the upper portion 220*b* of the insert, so as to be positioned to communicate the interior of the body with the headspace 215. The charging orifice is closed by a one-way valve 228, in the form of a flap valve. The valve may be defined by a flexible strip adhered at one end 228*a* to the interior surface of the cylindrical wall 226, with the remainder of the strip being hingeable to close or open the orifice. This arrangement is such that the valve is urged to the closing position when the interior pressure exceeds the exterior pressure and opens only when the exterior pressure exceeds the interior pressure.

The lower end wall 223 of the body is provided with a jetting orifice 230 and the aligning weight 224 has an aperture 225 permitting communication of the orifice 230 with the interior of the body. The jetting orifice 230 is closed by a rupturable member 231 in the form of a strip adhered to the exterior surface of the lower end wall 223 about the orifice. The orifice is openable when the internal pressure of the body is greater than the external pressure and the pressure differential exceeds a predetermined threshold. This may be determined by structuring the strip, so that it ruptures when the threshold is exceeded. This may be achieved by adhering the strip in a manner such that a sufficient area is not adhered around the orifice. With a heat and pressure sensitive adhesive, for example, the non-adhered area can be determined by non-application of heat and pressure at that area. Alternatively, the adhesive may fail when the threshold is exceeded, so that the member is blown away from the jetting orifice, forming a destructable seal.

FIG. 412 shows a modified construction of the rupturable member. The strip 231A is trapped between the aligning weight 24A and the bottom wall 223A of the insert. The weight 224A has a small orifice 225A forming the jetting orifice and the bottom wall 223A has a larger aperture 230A to permit rupture of the strip 231 A at the desired threshold pressure. The strip 231A may be held by compression between the weight and the bottom wall or may be adhered to either or both of the weight and the bottom wall.

This modification ensures a clean, predictable rupture of the strip at the threshold pressure.

The threshold is determined, so that the control member 231 will remain closed until the can is opened, the threshold only being exceeded in that circumstance.

In use, the insert 220 is charged with a pressurised gas through the charging aperture 227. After charging, the gas is retained in the body of the insert, by automatic closure of the one-way valve 228, with the external pressure being atmospheric pressure.

The charged insert is inserted into a can 11 prior to filling with beverage 12, so that the insert floats on the beverage. The can lid 13 is secured in place. The weighting of the insert causes it to float with the control member 231 submerged in the beverage and the charging valve 228 exposed to the headspace 15.

The filled can is then subjected to pasteurisation, which causes an increase in pressure in the can. The one-way charging valve 228 opens when this pressure exceeds that in the body of the insert to permit gas from the headspace 15 to enter the insert. The can is then cooled and the one-way valve 228 recloses maintaining an increased internal pressure in the insert, as the can cools down.

The control member 231 is constructed to withstand the pressure differentials caused by the pasteurisation and cooling steps.

On opening of the can at 14, there is a sudden drop in pressure in the can. This creates a pressure differential across the member 231 sufficient to exceed the threshold, so that the member is permanently opened and gas is jetted through the orifice 230 into the beverage.

The present inventor has discovered that this jetting action may cause the insert 220 to be forced away from the beverage 12, so that it contacts the lid 13. In order to ensure that the gas is jetted into the beverage 12, and not the headspace 15, the length of the insert 220 is made sufficiently large relative to the depth of the headspace, that the jetting orifice remains submerged when this happens. The outer surface of the upper end wall 222 is also made flat so that there is peripheral contact with the inner surface 218 of the lid 13. This arrangement does not cause angular movement of the insert, which could bring the jetting orifice into communication with the headspace.

When the insert body is made of aluminium, it will be coated against corrosion. Forming of the orifices 227,230 produces corrodible edges. The edge of the jetting orifice 230, however, is protected from corrosion by the strip 231. The edge of the charging orifice 227 is less likely to corrode, being exposed only to the headspace 15.

Figure 14:
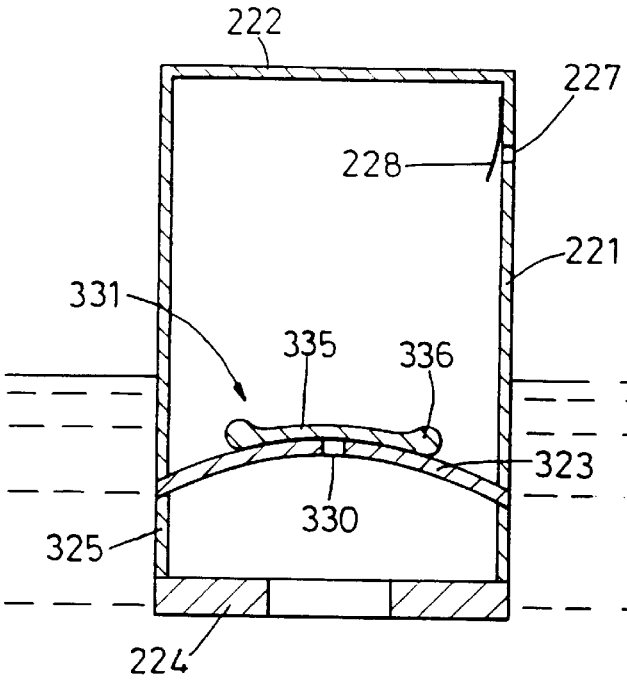
FIG. 14 is a sectional view similar to FIG. 12, of an insert with a modified form of control valve, with the valve in its closed position.
Figure 15:
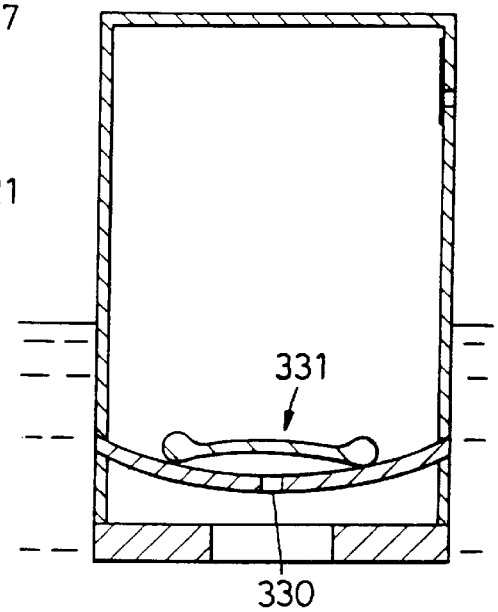
FIG. 15 is a view similar to FIG. 14 showing the modified control valve in open position.

A modification of the control member is shown in FIGS. 14 and 15. The lower end wall 223 of the body is replaced by a domed wall 323 having the jetting orifice 330. The aligning weight 224 is mounted below the domed wall by a skirt 325 leaving a gap between the domed wall and the weight. The convex side of the dome faces the interior of the insert.

The control member is a domed cap 331 having a central concave region 335 complementary to and lightly adhered to the convex side of the domed wall, so as to close the jetting orifice 330. The peripheral region 336 of the cap 331 is non-circular and is shaped to prevent snapping of the dome from the stable concave state to a convex state.

The domed wall 323 is constructed so that it snaps from the convex state shown in FIG. 14 to the concave state shown in FIG. 15 when the predetermined pressure differential threshold is exceeded. This releases the cap 331 from the domed wall and opens the jetting orifice. The threshold can readily be determined by the person skilled in the art using well known formulae including the elastic modules of the domed wall material, its thickness and radius of curvature.

The non-circular shaping of the peripheral region 336 of the cap ensures that, if the cap turns over, it cannot seal the orifice in the FIG. 14 state.

Figure 16:
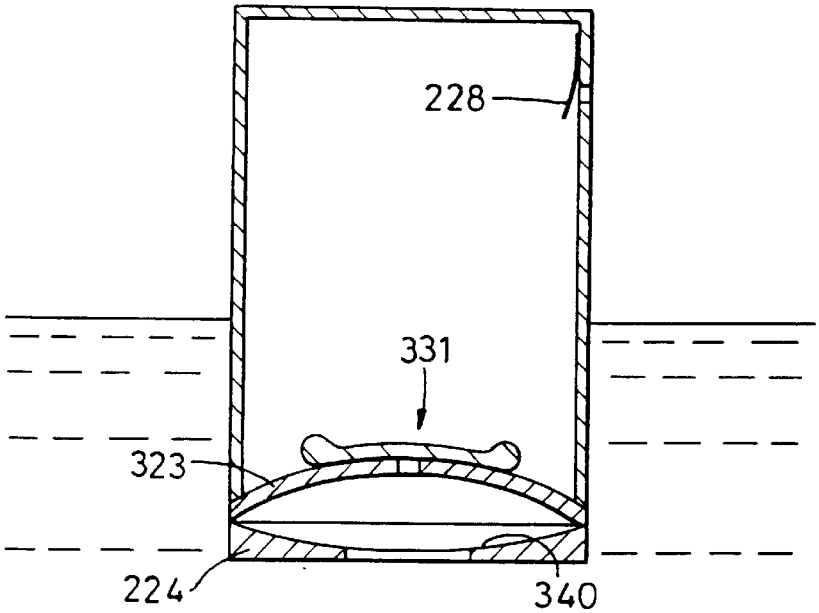
FIG. 16 is a view similar to FIG. 14, showing a modified aligning weight.

A further modification is shown in FIG. 16. In this modification, the weight 324 is provided closer to the domed wall 323 and is shaped with a concave surface 340 to accommodate the domed wall when it flips over to its alternate state.

Figure 17:
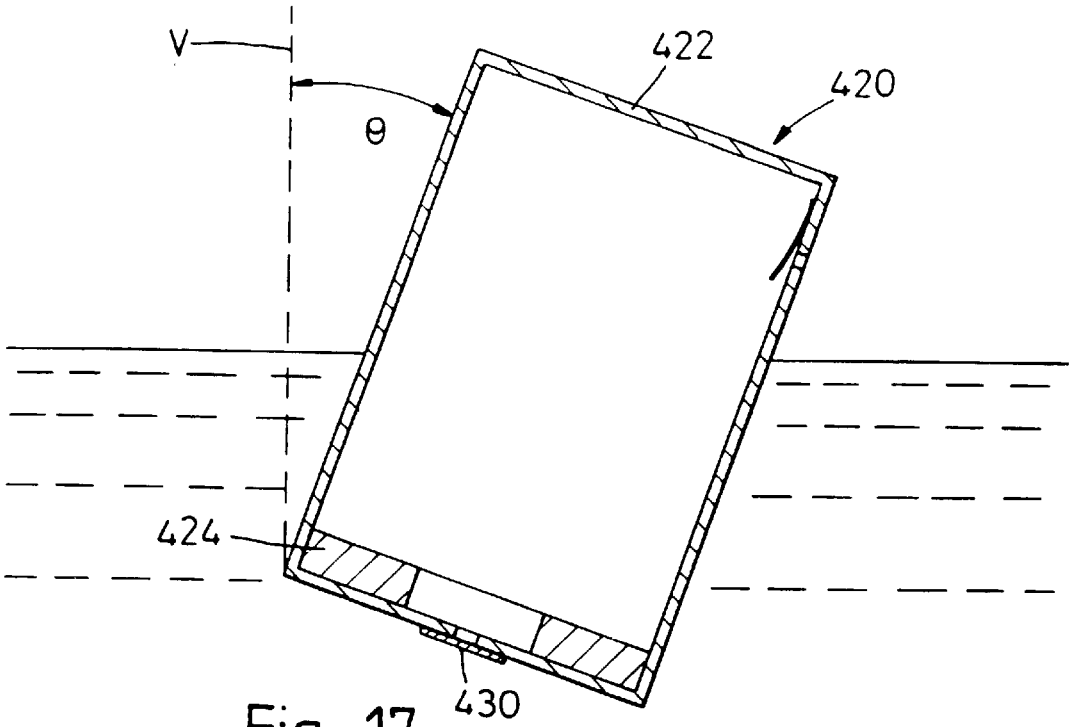
FIG. 17 shows a view similar to FIG. 11 of a modified insert, which floats in a canted orientation.

The insert may be permitted to float with its longitudinal axis at an acute angle to the vertical V, as shown in FIG. 17. This is especially useful where the body of the insert 420, and the weight 424, are made of aluminium, so that the amount of aluminium used can be reduced.

The insert floats at an angle θ to the vertical V and has a flat top surface 422 for contacting the interior of the lid of the can when the insert is propelled against the lid by the jetting force.

The jetting orifice remains below the surface of the liquid in the floating orientation of the insert and engagement of the flat surface 422 with the lid orients the insert longitudinal axis closer to the vertical on opening the can, so that the orifice remains below the liquid surface.

Figure 18:
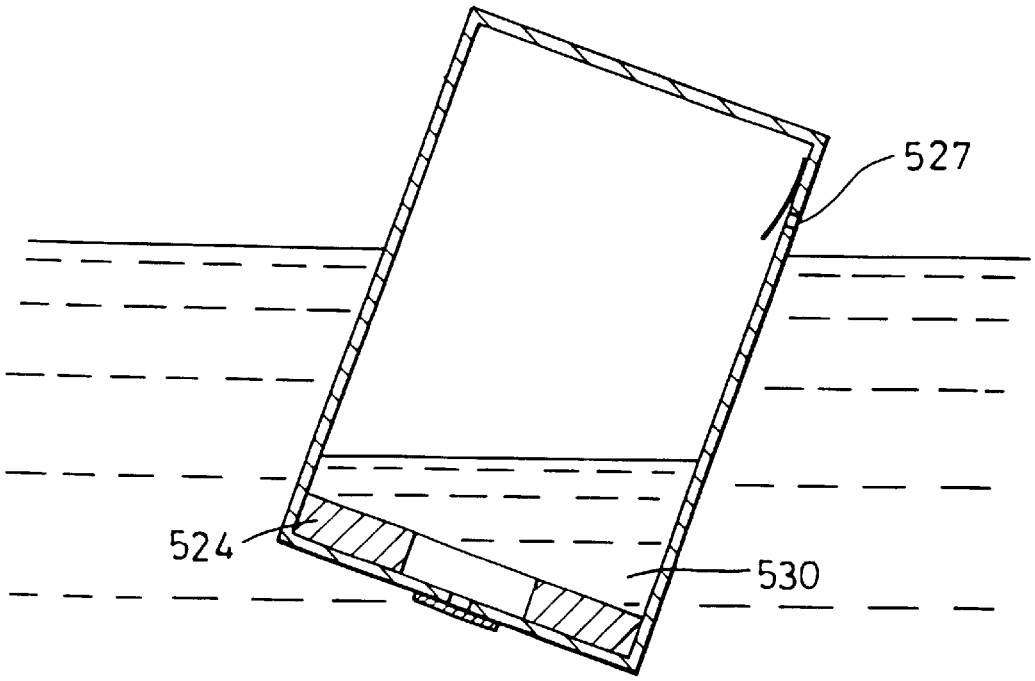
FIG. 18 shows a view similar to FIG. 17 of a modified insert containing liquid.

The weight 524 may be reduced still further, as shown in FIG. 18, if some liquid 530 is provided in the insert.

If one desires to jet a large quantity of liquid, one places the charging orifice below the liquid level. It should be noted that the level of liquid fill in the insert, which is achievable in this way is not limited to the insert height position corresponding to the original level of the liquid product in the primary container. One reason for this is that as the insert fills with liquid, its buoyancy will be reduced and the insert will sink lower into the liquid. The other reason is that liquid will flow into the insert until the gas pressure over the liquid in the insert is equal to that inside of the can. If desired, one can moderate the level of liquid within the insert by having two charging orifices, one below the liquid level in the can, and one above that level.

Figure 19:
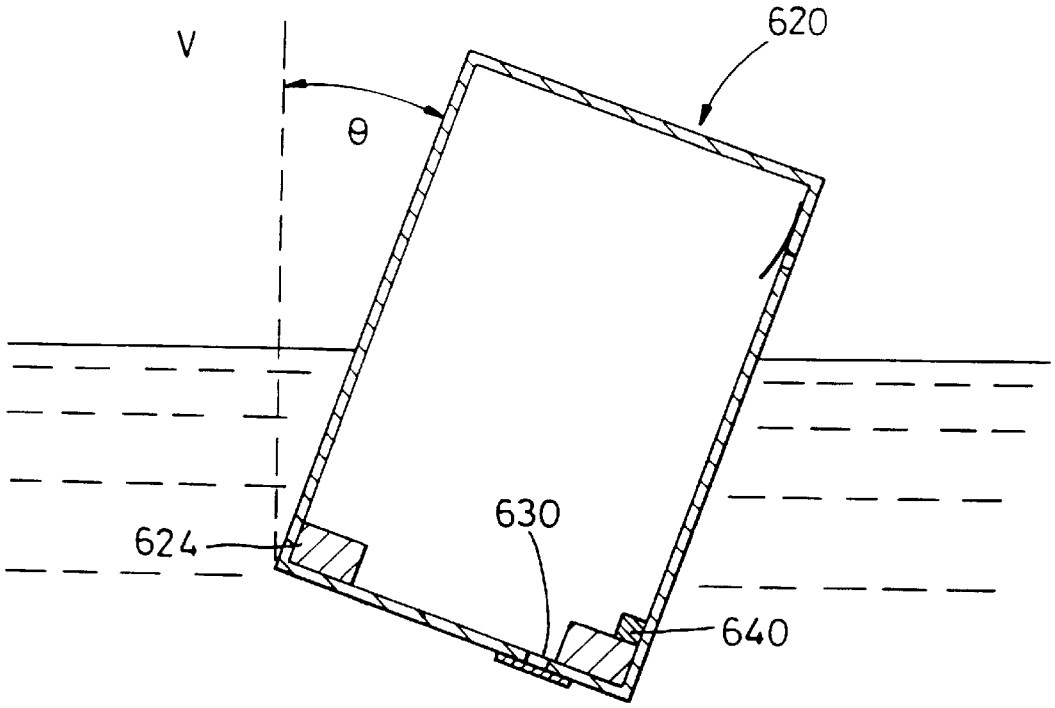
FIG. 19 shows a view similar to FIG. 17 of an insert with a modified aligning weight and repositioned jetting orifice.

A further embodiment is shown in FIG. 19. The insert 620 has a similar construction to that of FIG. 17 with a weight 624. In this embodiment, however, the total weight is made asymmetrical about the longitudinal axis. This is achieved by an additional weight 640 positioned at a specific circumferential location near the bottom of the insert. An asymmetrical disc could be provided instead. The additional weight 640 predetermines the rotational orientation of the insert, when the latter is floating at the angle θ to the vertical V.

The jetting orifice 630 is provided offset from the longitudinal axis towards the position of the additional weight 640. This means that the orifice is positioned at a deeper location than if the insert floated at a vertical orientation.

Figure 20:
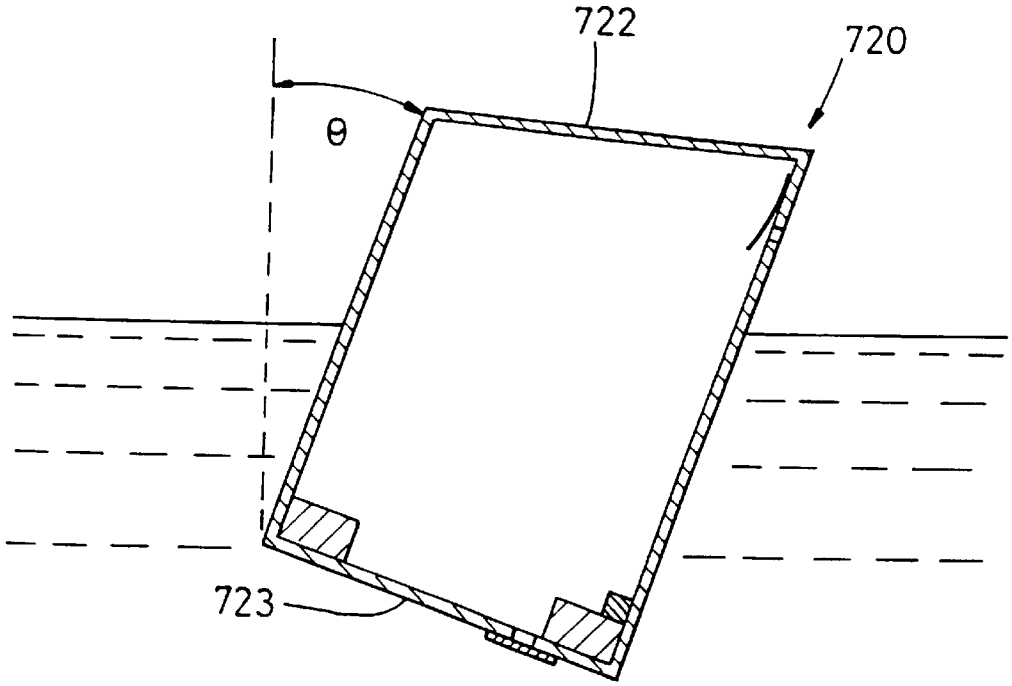
FIG. 20 shows a view similar to FIG. 19 of an insert with a modified upper end.

A modification of the embodiment of FIG. 19 is shown in FIG. 20. In this embodiment, the upper end 722 of the insert 720 is angled relative to the bottom end 723, so that the upper end is horizontal in the floating orientation of the insert.

When the insert is propelled against the lid, the floating orientation is, therefore, maintained.

This permits the insert to be shorter relative to the headspace than in the embodiments of FIGS. 11 or 19.

The position of the insert relative to the liquid surface during charging in the pasteurisation step is determined by its buoyancy and its position during jetting is determined by its longitudinal dimension relative to the headspace. If one wants to have the insert partially filled with liquid and later jet that liquid above the product liquid level, it is possible by reducing the buoyancy of the insert to the point where the charging orifice is covered with liquid during charging and providing sufficient headspace height to allow the insert to elevate in reaction to its jetting action. In this way, one can form a foam in that liquid near the surface while the rest of the liquid retains its inherent sparkle.

In a modification, the one way valve 228, shown e.g. in FIG. 11, may be omitted. In this modification, the charging orifice 227 is made of smaller area than the jetting orifice 230, so that the loss of pressure through the charging orifice 227, on opening of the container, is insufficient to prevent opening of the control member 231 and jetting through the jetting orifice 230.

In this modification, the internal pressure of the insert will be relatively low, since it will equalise with the internal pressure in the container.

The diameter of the jetting orifice may, for example, be 0.8 mm and that of the charging orifice 0.1 mm. The loss of gas through the charging orifice, on opening of the container, would be only 2% with this arrangement.

There should be substantially no oxygen in the insert in this modification, because the oxygen could diffuse through the charging orifice to the container contents. The insert would, therefore, preferably be filled in a non-oxidising atmosphere and protected from diffusion of oxygen into the insert until it is to be placed in the container. With a small charging orifice, significant diffusion would take several minutes, so protection during placement in the container and closure of the container would not be necessary.

The insert could be protected during shipping and storage by oxygen-barrier packaging or blocking of the charging orifice by oxygen-barrier tape. The packaging could comprise a bag containing a number of inserts and an oxygen scavenging agent.

The inserts are exposed to moisture within the can for a substantial period after sealing, until the pressure builds up, due to release of gas from the liquid. The filling procedure is carried out at low temperatures to retain a high gas content in the liquid. This means that the moisture sensitive layer is exposed to both moisture and a high pressure differential for some time until the pressures equalise. It would, therefore, be expected that a moisture sensitive layer would become weak during such exposure to pressure and moisture and burst before the temperatures were equalised.

It has been found, however, that EVOH is relatively moisture-insensitive at such low temperatures, so that the expected problem does not arise. The EVOH layer takes up moisture at higher temperatures and so reduces in strength only after the pressures have equalised.

EXAMPLE

An insert was made as disclosed with respect to FIG. 2, having a strip 26 made with EF-XL as disclosed with respect to that figure.

The insert was placed in an empty can body, which was then filled with beer at a temperature of about 2° C. Within a few seconds of filling, a lid was sealed to the can body. The can was subsequently inverted and pasteurised at 60° C. for about 15 minutes and then cooled to about 7° C. and stored at this temperature.

The can was subsequently opened and the film burst immediately on opening creating foam within the can.

Upon pouring the beer from the can into a glass, the entire beer contained small bubbles, which produced a foam on the beer typical of that produced by a draught-type beer.

Figure 21:
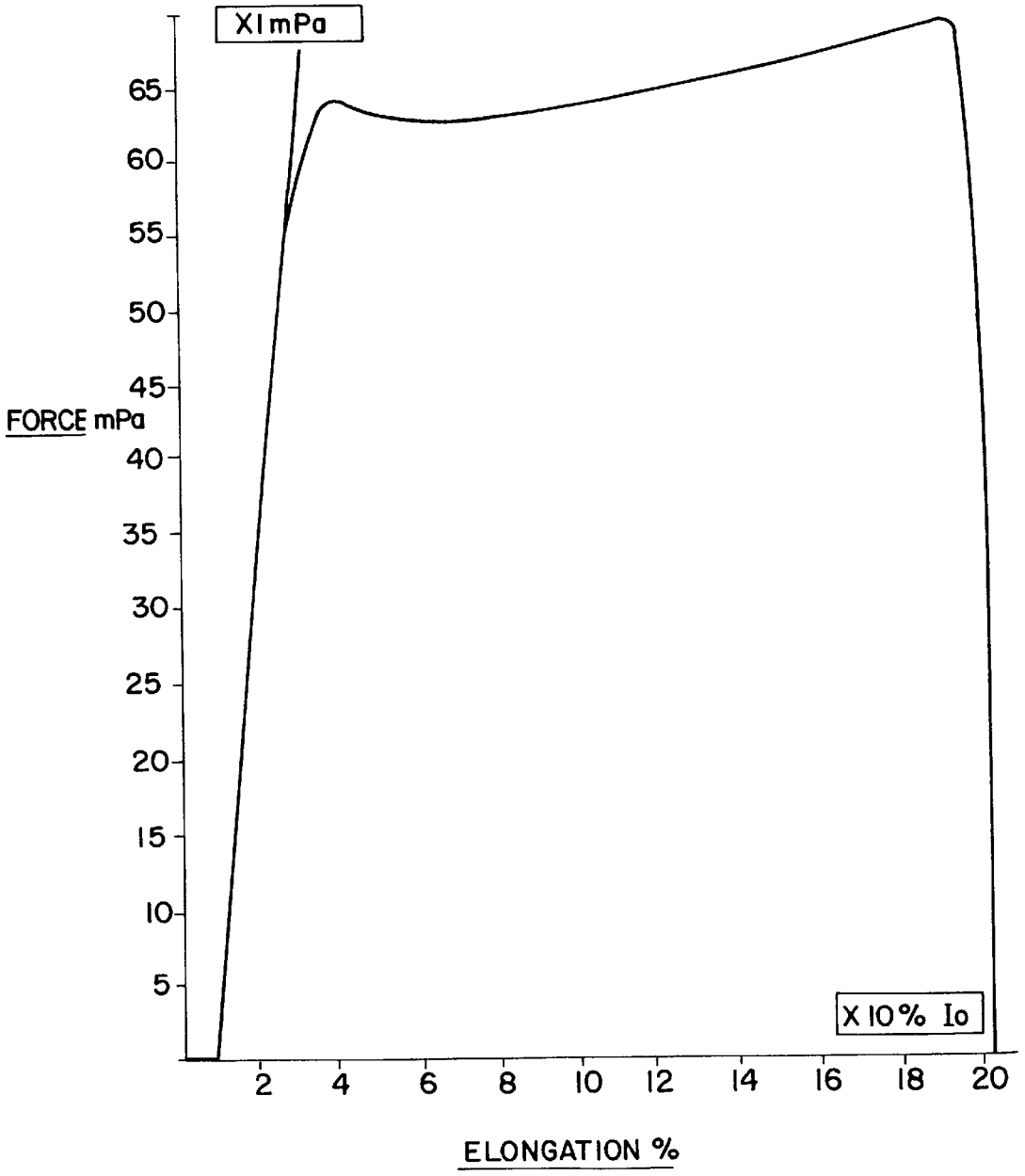
FIG. 21 is a graph plotting force against elongation from a tensile strength test carried out on a dry EVOH film.

FIG. 21 shows a dry EF-XL film subjected to a tensile strength test at room temperature. The film exhibited a slow increase in elongation with increasing force up to about 55 mPa.

Figure 22:
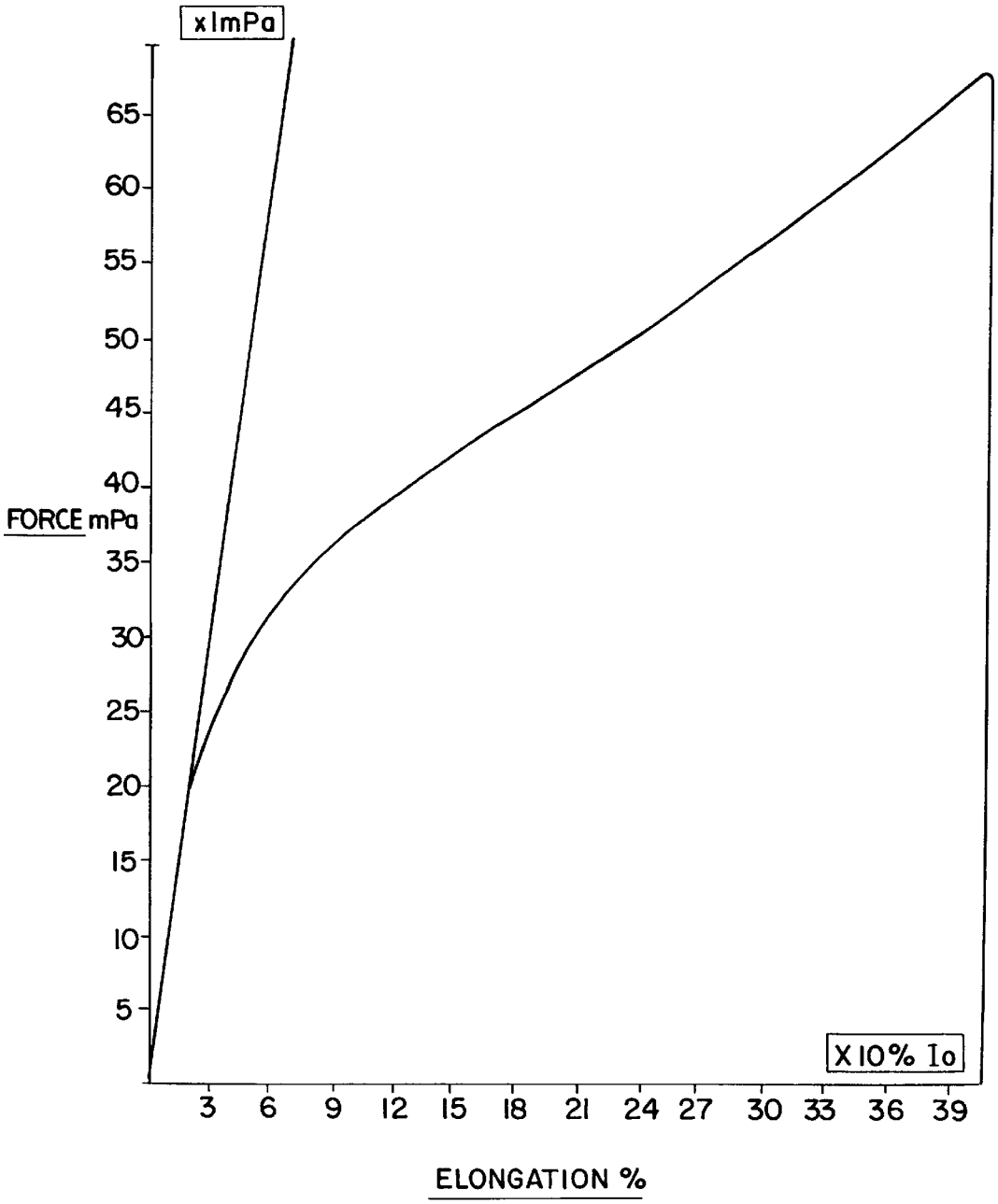
FIG. 22 is a graph, similar to FIG. 21, for a similar film, which has been soaked in beer, the film being at room temperature.

FIG. 22 shows results of the same test carried out on a wet EF-XL film, which had been soaked in beer, at room temperature. The film exhibited a slow increase in elongation only up to about 20 mPA, showing the substantial reduction of strength relative to a dry film.

Figure 23:
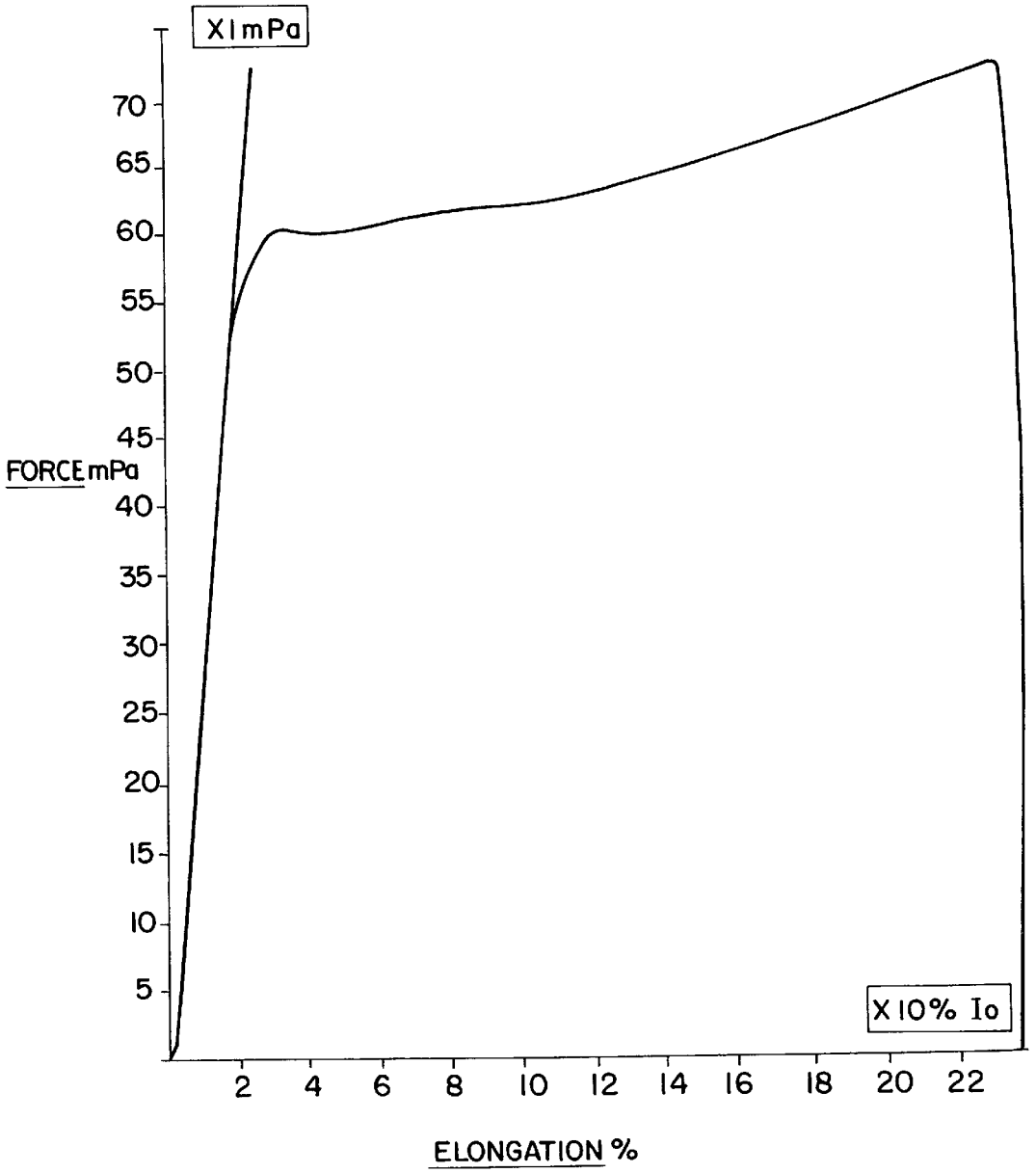
FIG. 23 is a graph, similar to FIG. 22, for a similar film, which has been soaked in beer, the film being at about 2° C.

FIG. 23 shows results of the same test carried out on a wet EF-XL film at about 2° C. The film had again been soaked in beer. The film exhibited a slow increase in elongation up to about 55 mPA, which illustrates that the strength of the wet film at low temperatures is comparable with that of a dry film.

We claim:

1. A foam-inducing insert for inclusion in a container containing a beverage with gas dissolved under pressure to initiate release of gas from the insert on opening of the container, the insert comprising:

a housing having a chamber;

gas within the chamber;

the chamber having an orifice through the housing;

and closure means closing the orifice and operable under pressure difference across the orifice caused in use by opening of the container, whereby gas is jetted into the container;

the closure means comprising a sealing member being rupturable and moisture-sensitive, so that the sealing member withstands greater pressure in the sealing member's dry state than after exposure to moisture and secured around the orifice to provide a seal, the seal being burstable under said pressure difference.

2. A foam-inducing insert for inclusion in a container containing a beverage with gas dissolved under pressure to initiate release of gas from the insert on opening of the container, the insert comprising:

a housing having a chamber;

gas within the chamber;

the chamber having an orifice through the housing;

and closure means closing the orifice and operable under pressure difference across the orifice caused in use by opening of the container, whereby gas is jetted into the container;

the closure means comprising a sealing member produced from an ethylene vinyl alcohol copolymer film and being rupturable and moisture-sensitive, so that the sealing member withstands greater pressure in the sealing member's dry state than after exposure to moisture and secured around the orifice to provide a seal, the seal being burstable under said pressure difference.

3. A foam-inducing insert of claim 2, wherein the copolymer film comprises less than 40% by weight ethylene monomers.

4. A foam-inducing insert of claim 2, wherein the copolymer film comprises less than 32% by weight ethylene monomers.

5. A foam-inducing insert of claim 2, wherein the thickness of the film is 10 to 20 microns.

6. A foam-inducing insert of claim 2, wherein the film is biaxially oriented.

7. A foam-inducing insert of claim 2, wherein the film is adhered to a metal substrate and the orifice is provided in the substrate.

8. A foam-inducing insert according to claim 1, wherein the sealing member is adhered around the orifice by a moisture sensitive adhesive whose adhesive properties reduce on exposure to moisture.

9. A foam-inducing insert according to claim 8, wherein the adhesive is an EVOH or polyvinyl alcohol adhesive.

10. A foam-inducing insert according to claim 8, wherein the sealing member is more strongly adhered in an outer region around an inner region adhered by said moisture sensitive adhesive and said member is rupturable under said pressure difference, when the member is released at said inner region.

11. A foam-inducing insert according to claim 1, wherein the housing includes a diaphragm defining a wall of the chamber and has a charging orifice through the housing on the side of the diaphragm remote from the chamber whereby pressure in the container, in use, is applied by means of the diaphragm to the gas in the first chamber.

12. A foam-inducing insert according to claim 11 wherein the charging orifice is closed by a gas-permeable member.

13. A foam-inducing insert according to claim 12, wherein the charging orifice is additionally closed by a rupturable gas impermeable barrier, which ruptures in use under the pressure within the container.

14. A foam-inducing insert according to claim 10, wherein the diaphragm is malleable and is collapsible under the pressure difference across the diaphragm caused by opening of the jetting orifice so as to expel gas from the second chamber at a substantially uniform rate.

15. A foam-inducing insert according to claim 10, in which the first chamber contains air and the diaphragm defines a second chamber containing a non-oxidising gas.

16. A foam-inducing insert according to claim 15, wherein the second chamber contains a non-oxidising gas and an oxygen scavenger.

17. A foam-inducing insert according to claim 1, wherein the insert is fixed within a closed container containing beverage under gas pressure.

18. A foam-inducing insert according to claim 1, wherein the insert is floatable on the beverage within a container.

19. A foam-inducing insert according to claim 1, wherein the housing is made of aluminium.

20. A foam inducing insert according to claim 1, wherein the sealing member is gas-permeable and a burstable gas barrier member is provided between the sealing member and the insert interior, the gas barrier member being burstable under the pressure within the container.

21. A foam inducing insert according to claim 1, wherein the housing has a charging orifice closed by a gas-permeable member and additionally closed by a burstable gas barrier member, which is burstable under pressure within the container.

22. A sealed container containing a beverage with gas dissolved under pressure and with a gas-containing headspace above the beverage, and an insert in the container and containing gas under pressure, the insert having:

a first orifice positioned to communicate with the headspace, a one-way valve closing the first orifice when the internal pressure exceeds the container interior pressure and openable when the container interior pressure exceeds the internal insert pressure, a second orifice positioned to communicate with the container interior, a burstable seal comprising a rupturable and moisture-sensitive strip closing the second orifice and rupturable under the differential pressure created on opening of the container to release the insert contents through the second orifice.

23. A sealed container according to claim 22, wherein the burstable seal is adapted to resist opening under differential pressures across the valve generated during pasteurisation of the container and its contents.

24. A sealed container according to claim 22, wherein the second orifice is positioned to communicate with the beverage.

25. A sealed container according to claim 22, wherein the insert floats in the beverage.

26. A sealed container according to claim 22, wherein the burstable seal is not reclosable once it has opened.

27. A sealed container according to claim 26, wherein the burstable seal is destroyed when it opens.

28. A sealed container according to claim 26, wherein the burstable seal is released from the insert when it opens.

29. An insert for insertion in a container containing a beverage with gas dissolved under pressure, prior to sealing of the container, to initiate release of the gas from the container on opening of the container, the insert comprising:

gas under pressure contained in the insert, a first orifice closed by a one-way valve when the internal pressure exceeds the external pressure, a second orifice spaced from the first orifice and closable by a burstable seal comprising a rupturable and moisture-sensitive strip held closed against a pressure differential between the internal pressure and atmospheric pressure and against a predetermined pressure differential, the burstable seal being openable when said predetermined pressure differential is exceeded.

30. An insert according to claim 29, wherein said predetermined pressure is sufficient to prevent opening of the burstable seal under pasteurisation conditions with the insert inserted in a beverage container.

31. An insert according to claim 29, wherein said predetermined pressure differential is such as to permit opening of the burstable seal when the sealed beverage container is opened.

32. An insert according to claim 29, which is floatable on a beverage.

33. An insert according to claim 29, wherein the burstable seal is not reclosable once it has opened.

34. An insert according to claim 33, wherein the burstable seal is destroyed when it opens.

35. An insert according to claim 33 wherein the burstable seal is released from the insert when it opens.

36. A method of producing a sealed container containing a beverage with gas dissolved under pressure and an insert in the container containing gas under pressure, which gas is released on opening of the container, the method comprising:

charging the insert with gas under pressure through a first orifice, the insert having a one-way valve which is urged to close the first orifice when an internal insert pressure exceeds an external pressure, providing the insert with a second orifice and a burstable seal comprising rupturable and moisture-sensitive strip, which is held closing the second orifice and withstands a pressure differential between the internal pressure and the external pressure, inserting the insert into a container containing the beverage and sealing the container, the burstable seal being openable under a pressure differential produced on opening of the sealed container.

37. A method according to claim 36, including exposing the sealed container to pasteurising conditions such that the pressure in the container is increased and communication occurs through the first orifice between the insert and the container interiors, and cooling the sealed container, so that the valve closes to maintain the increased pressure in the insert, the burstable seal also withstanding the pressure differentials during the pasteurising and cooling steps.

38. A sealed container containing a beverage with gas dissolved under pressure and with a gas-containing headspace above the beverage, and an insert in the container and containing gas under pressure, the insert having:

a first orifice positioned to communicate with the headspace, a second orifice positioned to communicate with the beverage, the first orifice being smaller of smaller area than the second orifice, and a seal comprising a rupturable and moisture-sensitive strip held in a position closing the second orifice and openable under a differential pressure created on opening of the container to release the insert contents through the second orifice.

39. An insert for insertion in a container containing a beverage with gas dissolved under pressure, prior to sealing of the container, to initiate release of the gas from the container on opening of the container, the insert being floatable in a liquid of the approximate density of water and comprising:

gas contained in the insert, a first orifice and a second orifice, the first orifice being located above a liquid level and the second orifice being located below the liquid level when the insert is floating, the first orifice being of smaller area than the second orifice, and a seal comprising a rupturable and moisture-sensitive strip closing the second orifice and openable when a predetermined pressure differential is exceeded.

40. A method of producing a sealed container containing a beverage with gas dissolved under pressure and an insert in the container containing gas under pressure, which gas is released on opening of the container, the method comprising:

providing the insert with a first orifice and a second orifice, the first orifice having a smaller area than the second orifice, providing a seal comprising a rupturable and moisture-sensitive strip, which closes the second orifice, inserting the insert into a container containing the beverage so that the insert floats on the beverage with the first orifice above the beverage level and the second orifice below the beverage level, and sealing the container, seal being openable under a differential produced on opening of the sealed container.

41. A method according to claim 40, including exposing the sealed container to pasteurising conditions and then cooling the sealed container.

* * * * *